US006054259A

United States Patent [19]

Hioki

[11] Patent Number: 6,054,259

[45] Date of Patent: Apr. 25, 2000

[54] SILVER HALIDE PHOTOGRAPHIC MATERIAL

[75] Inventor: Takanori Hioki, Kanagawa, Japan

[73] Assignee: Fuji Photo Film Co., Ltd., Kanagawa, Japan

[21] Appl. No.: 09/040,401

[22] Filed: Mar. 18, 1998

[30] Foreign Application Priority Data

Mar. 18, 1997 [JP] Japan ..... 9-065197

[51] Int. Cl.[7] ..... G03C 1/10; G03C 1/26

[52] U.S. Cl. ..... 430/578; 430/579; 430/592

[58] Field of Search ..... 430/578, 579, 430/592

[56] References Cited

U.S. PATENT DOCUMENTS

| | | | |
|---|---|---|---|
| 3,706,570 | 12/1972 | Nakazawa et al. | 430/578 |
| 3,971,664 | 7/1976 | Nakazawa et al. | 430/578 |
| 5,112,731 | 5/1992 | Miyasaka | 430/578 |
| 5,457,022 | 10/1995 | Hioki et al. | 430/578 |
| 5,587,279 | 12/1996 | Mifune et al. | 430/567 |
| 5,763,153 | 6/1998 | Tsuzuki et al. | 430/584 |

FOREIGN PATENT DOCUMENTS

| | | |
|---|---|---|
| 6-273879 | 9/1994 | Japan . |
| 9-248556 | 9/1996 | Japan . |
| 9-160160 | 6/1997 | Japan . |

*Primary Examiner*—Janet Baxter
*Assistant Examiner*—Amanda C. Walke
*Attorney, Agent, or Firm*—Sughrue, Mion, Zinn, Macpeak & Seas, PLLC

[57] ABSTRACT

A silver halide photographic material which contains at least one methine compound represented by the following formula (I) or (II):

(I)

wherein $Z_1$, $Z_2$ and $Z_3$ each represents an atomic group necessary to form a 5- or 6-membered nitrogen-containing heterocyclic ring; $R_1$ and $R_3$ each represents an alkyl group; $R_2$ represents a hydrogen atom, an alkyl group, an aryl group or a heterocyclic group; $L_1$, $L_2$, $L_3$, $L_4$, $L_5$, $L_6$, $L_7$, $L_8$ and $L_9$ each represents a methine group; $p_1$ and $p_2$ each represents 0 or 1; $n_1$ and $n_2$ each represents 0, 1, 2, 3 or 4; $M_1$ represents a counter ion to balance a charge; and $m_1$ represents a number of 0 or more necessary for to neutralize a charge in the molecule; provided that at least one of $R_1$, $R_2$, $R_3$, $Z_1$, $Z_2$, $Z_3$, $L_1$, $L_2$, $L_3$, $L_4$, $L_5$, $L_6$, $L_7$, $L_8$ and $L_9$ has a thioether group;

(II)

wherein $Z_4$, $Z_5$ and $Z_6$ each represents an atomic group necessary to form a 5- or 6-membered nitrogen-containing heterocyclic ring; $R_4$ represents an alkyl group; $R_5$ and $R_6$ each represents a hydrogen atom, an alkyl group, an aryl group or a heterocyclic group; $L_{10}$, $L_{11}$, $L_{12}$, $L_{13}$, $L_{14}$ and $L_{15}$ each represents a methine group; $p_3$ represents 0 or 1; $n_3$ and $n_4$ each represents 0, 1, 2, 3 or 4; $M_2$ represents a counter ion to balance a charge; and $m_2$ represents a number of 0 or more necessary for to neutralize a charge in the molecule; provided that at least one of $R_4$, $R_5$, $R_6$, $Z_4$, $Z_5$, $Z_6$, $L_{10}$, $L_{11}$, $L_{12}$, $L_{13}$, $L_{14}$ and $L_{15}$ has a thioether group.

5 Claims, No Drawings

SILVER HALIDE PHOTOGRAPHIC MATERIAL

FIELD OF THE INVENTION

The present invention relates to a silver halide photographic material and more particularly relates to a silver halide photographic material which is high sensitive, generates less fog and exhibits excellent storage stability.

BACKGROUND OF THE INVENTION

Every effort has been done for long years for higher sensitization and reduction of residual colors after processing of silver halide photographic materials. It is known that sensitizing dyes used for spectral sensitization have a great influence on photographic capabilities of a silver halide photographic material. A slight structural difference of sensitizing dyes largely affects photographic capabilities such as sensitivity, fog or storage stability but it is difficult to estimate the effects in advance, therefore, many engineers have endeavored to synthesize various kinds of sensitizing dyes and examine photographic capabilities thereof. However, photographic capabilities cannot be forecast yet up to date.

From the above reasons, techniques for spectrally sensitizing silver halide highly sensitively without generating mal-effects, such as fog, have been demanded.

SUMMARY OF THE INVENTION

An object of the present invention is to provide a silver halide photographic material which is high sensitive, generates less fog and exhibits excellent storage stability.

The present inventors have eagerly studied and achieved the object of the present invention by the following means.

(1) A silver halide photographic material which contains at least one methine compound represented by the following formula (I) or (II):

(I)

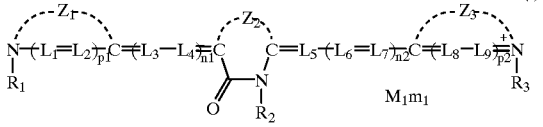

$M_1m_1$ wherein $Z_1$, $Z_2$ and $Z_3$ each represents an atomic group necessary to form a 5- or 6-membered nitrogen-containing heterocyclic ring; $R_1$ and $R_3$ each represents an alkyl group; $R_2$ represents a hydrogen atom, an alkyl group, an aryl group or a heterocyclic group; $L_1$, $L_2$, $L_3$, $L_4$, $L_5$, $L_6$, $L_7$, $L_8$ and $L_9$ each represents a methine group; $p_1$ and $p_2$ each represents 0 or 1; $n_1$ and $n_2$ each represents 0, 1, 2, 3 or 4; $M_1$ represents a counter ion to balance a charge; and $m_1$ represents a number of 0 or more necessary for to neutralize a charge in the molecule; provided that at least one of $R_1$, $R_2$, $R_3$, $Z_1$, $Z_2$, $Z_3$, $L_1$, $L_2$, $L_3$, $L_4$, $L_5$, $L_6$, $L_7$, $L_8$ and $L_9$ has a thioether group;

(II)

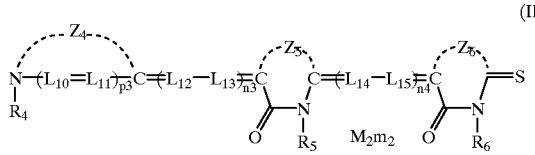

$M_2m_2$ wherein $Z_4$, $Z_5$ and $Z_6$ each represents an atomic group necessary to form a 5- or 6-membered nitrogen-containing heterocyclic ring; $R_4$ represents an alkyl group; $R_5$ and $R_6$ each represents a hydrogen atom, an alkyl group, an aryl group or a heterocyclic group; $L_{10}$, $L_{11}$, $L_{12}$, $L_{13}$, $L_{14}$ and $L_{15}$ each represents a methine group; $p_3$ represents 0 or 1; $n_3$ and $n_4$ each represents 0, 1, 2, 3 or 4; $M_2$ represents a counter ion to balance a charge; and $m_2$ represents a number of 0 or more necessary for to neutralize a charge in the molecule; provided that at least one of $R_4$, $R_5$, $R_6$, $Z_4$, $Z_5$, $Z_6$, $L_{10}$, $L_{11}$, $L_{12}$, $L_{13}$, $L_{14}$ and $L_{15}$ has a thioether group.

(2) The silver halide photographic material as described in (1), wherein in formula (I) at least one of $R_1$, $R_2$, $R_3$, $Z_1$, $Z_2$ and $Z_3$ has a thioether group and in formula (II) at least one of $R_4$, $R_5$, $R_6$, $Z_4$, $Z_5$ and $Z_6$ has a thioether group.

(3) The silver halide photographic material as described in (2), wherein the heterocyclic ring having a thioether group in the methine compound represented by formula (I) or (II) is a nucleus other than a quinoline nucleus and a pyridine nucleus.

(4) The silver halide photographic material as described in (1), wherein the methine compound represented by formula (I) is represented by the following formula (III):

(III)

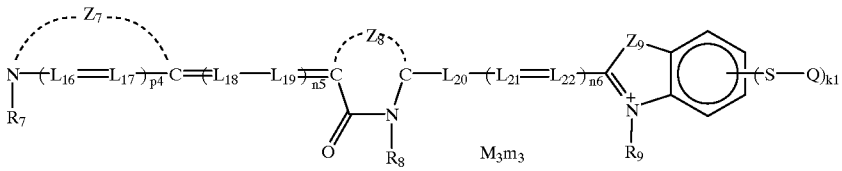

$M_3m_3$ wherein $Z_7$ has the same meaning as $Z_1$; $Z_8$ has the same meaning as $Z_2$; $Z_9$ represents a sulfur atom, a selenium atom or an oxygen atom; $R_7$ has the same meaning as $R_1$; $R_8$ has the same meaning as $R_2$; $R_9$ has the same meaning as $R_3$; $L_{16}$ has the same meaning as $L_1$; $L_{17}$ has the same meaning as $L_2$; $L_{18}$ has the same meaning as $L_3$; $L_{19}$ has the same meaning as $L_4$; $L_{20}$ has the same meaning as $L_5$; $L_{21}$ has the same meaning as $L_6$; $L_{22}$ has the same meaning as $L_7$; $p_4$ has the same meaning as $p_1$; $n_5$ has the same meaning as $n_l$; $n_6$ has the same meaning as $n_2$; $M_3$ has the same meaning as $M_1$; $m_3$ has the same meaning as $m_1$; Q represents an alkyl group, an aryl group or a heterocyclic group; and $k_1$ represents 1, 2, 3 or 4.

DETAILED DESCRIPTION OF THE INVENTION

Compounds for use in the present invention are described in detail below.

Examples of 5- or 6-membered nitrogen-containing heterocyclic rings represented by $Z_1$, $Z_3$, $Z_4$ or $Z_7$ in formula (I), (II) or (III) include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b] quinoxaline nucleus, an oxadiazole nucleus, a thiadiazole nucleus, a tetrazole nucleus, and a pyrimidine nucleus.

Of the above nuclei, preferred heterocyclic rings substituted with the thioether group of the present invention are nuclei other than a pyridine nucleus and a quinoline nucleus, more preferred are a benzoxazole nucleus, a benzothiazole nucleus, a benzoselenazole nucleus, and a benzimidazole nucleus, particularly preferred are a benzoxazole nucleus and a benzothiazole nucleus, and most preferred is a benzothiazole nucleus.

Preferred heterocyclic rings which are not substituted with the thioether group are a benzoxazole nucleus, a thiazole nucleus, a benzothiazole nucleus, a benzoselenazole nucleus, and a benzimidazole nucleus, more preferred are a benzoxazole nucleus, a thiazole nucleus, and a benzothiazole nucleus, and particularly preferred is a benzothiazole nucleus.

Assuming that the substituents on $Z_1$, $Z_3$, $Z_4$ and $Z_7$ are V, the substituents represented by V are not particularly limited. Examples of V include, for example, a halogen atom (e.g., chlorine, bromine, iodine, fluorine), a mercapto group, a cyano group, a carboxyl group, a phosphoric acid group, a sulfo group, a hydroxyl group, a carbamoyl group (hereinafter, "a carbamoyl group" means a carbamoyl group which may have a substituent), for example, a carbamoyl group having from 1 to 10, preferably from 2 to 8, more preferably from 2 to 5, carbon atoms (e.g., methylcarbamoyl, ethylcarbamoyl, morpholinocarbonyl), a sulfamoyl group (which may be substituted), for example, a sulfamoyl group having from 0 to 10, preferably from 2 to 8, more preferably from 2 to 5, carbon atoms (e.g., methylsulfamoyl, ethylsulfamoyl, piperidinosulfonyl), a nitro group, an alkoxyl group (which may be substituted), for example, an alkoxyl group having from 1 to 20, preferably from 1 to 10, more preferably from 1 to 8, carbon atoms (e.g., methoxy, ethoxy, 2-methoxyethoxy, 2-phenylethoxy), an aryloxy group (which may be substituted), for example, an aryloxy group having from 6 to 20, preferably from 6 to 12, more preferably from 6 to 10, carbon atoms (e.g., phenoxy, p-methylphenoxy, p-chlorophenoxy, naphthoxy), an acyl group (which may be substituted), for example, an acyl group having from 1 to 20, preferably from 2 to 12, more preferably from 2 to 8, carbon atoms (e.g., acetyl, benzoyl, trichloroacetyl), an acyloxy group (which may be substituted), for example, an acyloxy group having from 1 to 20, preferably from 2 to 12, more preferably from 2 to 8, carbon atoms (e.g., acetyloxy, benzoyloxy), an acylamino group (which may be substituted), for example, an acylamino group having from 1 to 20, preferably from 2 to 12, more preferably from 2 to 8, carbon atoms (e.g., acetylamino), a sulfonyl group (which may be substituted), for example, a sulfonyl group having from 1 to 20, preferably from 1 to 10, more preferably from 1 to 8, carbon atoms (e.g., methanesulfonyl, ethanesulfonyl, benzenesulfonyl), a sulfinyl group (which may be substituted), for example, a sulfinyl group having from 1 to 20, preferably from 1 to 10, more preferably from 1 to 8, carbon atoms (e.g., methanesulfinyl, benzenesulfinyl), a sulfonylamino group (which may be substituted), for example, a sulfonylamino group having from 1 to 20, preferably from 1 to 10, more preferably from 1 to 8, carbon atoms (e.g., methanesulfonylamino, ethanesulfonylamino, benzenesulfonylamino), an amino group, a substituted amino group (which may be substituted), for example, a substituted amino group having from 1 to 20, preferably from 1 to 12, more preferably from 1 to 8, carbon atoms (e.g., methylamino, dimethylamino, benzylamino, anilino, diphenylamino), an ammonium group (which may be substituted), for example, an ammonium group having from 0 to 15, preferably from 3 to 10, more preferably from 3 to 6, carbon atoms (e.g., trimethylammonium, triethylammonium), a hydrazino group (which may be substituted), for example, a hydrazino group having from 0 to 15, preferably from 1 to 10, more preferably from 1 to 6, carbon atoms (e.g., trimethylhydrazino), a ureido group (which may be substituted), for example, a ureido group having from 1 to 15, preferably from 1 to 10, more preferably from 1 to 6, carbon atoms (e.g., ureido, N,N-dimethylureido), an imido group (which may be substituted), for example, an imido group having from 1 to 15, preferably from 1 to 10, more preferably from 1 to 6, carbon atoms (e.g., succinimido), an alkyl- or arylthio group (which may be substituted), for example, an alkyl-, aryl- or heterocyclylthio group having from 1 to 20, preferably from 1 to 12, more preferably from 1 to 8, carbon atoms (e.g., methylthio, ethylthio, carboxyethylthio, sulfobutylthio, phenylthio, 2-pyridylthio), an alkoxycarbonyl group (which may be substituted), for example, an alkoxycarbonyl group having from 2 to 20, preferably from 2 to 12, more preferably from 2 to 8, carbon-atoms (e.g., methoxycarbonyl, ethoxycarbonyl, benzyloxycarbonyl), an aryloxycarbonyl group (which may be substituted), for example, an aryloxycarbonyl group having from 6 to 20, preferably from 6 to 12, more preferably from 6 to 8, carbon atoms (e.g., phenoxycarbonyl), an alkyl group (which may be substituted), for example, an unsubstituted alkyl group having from 1 to 18, preferably from 1 to 10, more preferably from 1 to 5, carbon atoms (e.g., methyl, ethyl, propyl, butyl), a substituted alkyl group having from 1 to 18, preferably from 1 to 10, more preferably from 1 to 5, carbon atoms (e.g., hydroxymethyl, trifluoromethyl, benzyl, carboxyethyl, ethoxycarbonylmethyl, acetylaminomethyl, in addition, an unsaturated hydrocarbon group preferably having from 2 to 18, more preferably from 3 to 10, particularly preferably from 3 to 5, carbon atoms (e.g., vinyl, ethynyl, 1-cyclohexenyl, benzylidyne, benzylidene) is also included in a substituted alkyl group), an aryl group (which may be substituted), for example, a substituted or unsubstituted aryl group having from 6 to 20, preferably from 6 to 15, more preferably from 6 to 10, carbon atoms (e.g., phenyl, naphthyl, p-carboxyphenyl, p-nitrophenyl, 3,5-dichlorophenyl, p-cyanophenyl, m-fluorophenyl, p-tolyl), and a heterocyclic group (which may be substituted), for example, a heterocyclic group having from 1 to 20, preferably from 2 to 10, more preferably from 4 to 6, carbon atoms (e.g., pyridyl, 5-methylpyridyl, thienyl, furyl, morpholino, tetrahydrofurfuryl). The heterocyclic group may have the condensed structure of a benzene ring, a naphthalene ring and an anthracene ring. These substituents may further be substituted with V.

Preferred substituents on $Z_1$ are an alkyl group, an aryl group, an alkoxyl group, an alkylthio group, a halogen atom, an acyl group, a cyano group, a sulfonyl group, and a benzene condensed ring, more preferably an alkyl group, an aryl group, an alkylthio group, a halogen atom, an acyl group, a sulfonyl group, and a benzene condensed ring, and particularly preferably a methyl group, a phenyl group, a methoxy group, a methylthio group, a chlorine atom, a bromine atom, an iodine atom and a benzene condensed ring, and most preferably a phenyl group, a methylthio group, a chlorine atom, a bromine atom, an iodine atom and a benzene condensed ring.

The methine group represented by $L_1$, $L_2$, $L_8$, $L_9$, $L_{10}$, $L_{11}$, $L_{16}$ and $L_{17}$ each may have a substituent, the above substituents exemplified as V can be cited as examples of substituents for them, and preferably an unsubstituted methine group.

$p_1$, $p_2$, $p_3$ and $p_4$ each is 0 or 1 and preferably 0.

$Z_9$ represents a sulfur atom, a selenium atom or an oxygen atom, preferably a sulfur atom or an oxygen atom, and more preferably a sulfur atom.

$Z_6$ represents an atomic group necessary to form an acidic nucleus and any form of an acidic nucleus of general merocyanine dyes can be used. An acidic nucleus used in the present invention is defined, for example, by James, *The Theory of the Photographic Process,* 4th Ed., p. 198, Macmillan (1977). Specifically, those disclosed in U.S. Pat. Nos. 3,567,719, 3,575,869, 3,804,634, 3,837,862, 4,002,480, 4,925,777 and JP-A-3-167546 (the term "JP-A" as used herein means an "unexamined published Japanese patent application") can be exemplified.

When the acidic nucleus forms a 5- or 6-membered nitrogen-containing heterocyclic ring comprising carbon, nitrogen and chalcogen (typically, oxygen, sulfur, selenium, tellurium) atoms, the following nuclei are exemplified as preferred examples: 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazoline-2,4-dione, isooxazolin-5-one, 2-thiazolin-4-one, thiazolidin-4-one, thiazolidine-2,4-dione, rhodanine, thiazolidine-2,4-dithione, isorhodanine, indane-1,3-dione, thiophen-3-one, thiophen-3-one-1,1-dioxide, indolin-2-one, indolin-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, pyrido[1,2-a]pyrimidine-1,3-dione, pyrazolo[1,5-b]quinazolone, pyrazolo[1,5-a]benzimidazole, pyrazolopyridone, 1,2,3,4-tetrahydroquinoline-2,4-dione, 3-oxo-2,3-dihydrobenzo[d]thiophene-1,1-dioxide, and 3-dicyanomethine-2,3-dihydrobenzo[d]thiophene-1,1-dioxide.

Preferred as $Z_6$ are hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid, and 2-thiobarbituric acid, more preferred are hydantoin, 2- or 4-thiohydantoin, 2-oxazolin-5-one, rhodanine, barbituric acid, and 2-thiobarbituric acid, and particularly preferred are 2- or 4-thiohydantoin, 2-oxazolin-5-one and rhodanine.

The 5- or 6-membered nitrogen-containing heterocyclic ring formed by $Z_2$, $Z_5$ and $Z_8$ is a heterocyclic ring obtained by eliminating an oxo group or a thioxo group from the heterocyclic ring formed by $Z_6$, preferably eliminating an oxo group or a thioxo group from hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid, or 2-thiobarbituric acid, more preferably eliminating an oxo group or a thioxo group from hydantoin, 2- or 4-thiohydantoin, 2-oxazolin-5-one, rhodanine, barbituric acid, or 2-thiobarbituric acid, and particularly preferably eliminating an oxo group or a thioxo group from 2- or 4-thiohydantoin, 2-oxazolin-5-one, or rhodanine.

$R_1$, $R_3$, $R_4$, $R_7$ and $R_9$ each represents an alkyl group, e.g., an unsubstituted alkyl group having from 1 to 18, preferably from 1 to 7, particularly preferably from 1 to 4, carbon atoms (e.g., methyl, ethyl, propyl, isopropyl, butyl, isobutyl, hexyl, octyl, dodecyl, octadecyl), or a substituted alkyl group having from 1 to 18, preferably from 1 to 7, particularly preferably from 1 to 4, carbon atoms [e.g., a heterocyclic group substituted with V, which is described above as a substituent of $Z_1$, etc., can be exemplified, preferably an aralkyl group (e.g., benzyl, 2-phenylethyl), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy)ethyl), an alkylthioalkyl group (e.g., 2-methylthioethyl, 2-(2-methylthioethylthio)ethyl), an arylthioalkyl group (e.g., 2-phenylthioethyl, 2-(1-naphthylthio)ethyl), a heterocyclylthioalkyl group (e.g., 2-pyridylthioethyl, 2-thienylthioethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylcarbamoylmethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfoalkenyl group (e.g., sulfopropenyl), a sulfatoalkyl group (e.g., 2-sulfatoethyl, 3-sulfatopropyl, 4-sulfatobutyl), a heterocyclic group-substituted alkyl group (e.g., 2-(pyrrolidin-2-one-1-yl)ethyl, tetrahydrofurfuryl), or an alkylsulfonylcarbamoylmethyl group (e.g., methanesulfonylcarbamoylmethyl)].

Preferred alkyl groups for $R_1$, $R_3$, $R_4$, $R_7$ and $R_9$ are the above-described carboxyalkyl group, sulfoalkyl group, sulfoalkenyl group, unsubstituted alkyl group, alkylthioalkyl group, arylthioalkyl group and heterocyclylthioalkyl group.

As alkyl groups represented by $R_2$, $R_5$, $R_6$ and $R_8$, unsubstituted alkyl groups or substituted alkyl groups as described above as examples of the substituents of $R_1$, etc., can be cited and the similar ones are preferred. Further, an unsubstituted aryl group having from 6 to 20, preferably from 6 to 10, more preferably from 6 to 8, carbon atoms (e.g., phenyl, 1-naphthyl), a substituted aryl group having from 6 to 20, preferably from 6 to 10, more preferably from 6 to 8, carbon atoms (e.g., aryl groups substituted with V described as the substituent of $Z_1$, etc., specifically p-methoxyphenyl, p-methylphenyl, p-chlorophenyl), an unsubstituted heterocyclic group having from 1 to 20, preferably from 3 to 10, more preferably from 4 to 8, carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl), and a substituted heterocyclic group having from 1 to 20, preferably from 3 to 10, more preferably from 4 to 8, carbon atoms (e.g., heterocyclic groups substituted with V described as the substituent of $Z_1$, etc., specifically 5-methyl-2-thienyl, 4-methoxy-2-pyridyl) can be cited.

Preferred groups as $R_2$, $R_5$, $R_6$ and $R_8$ are methyl, ethyl, 2-sulfoethyl, 3-sulfopropyl, 3-sulfobutyl, 4-sulfobutyl, carboxymethyl, 2-methylthioethyl, 2-phenylthioethyl, phenyl, 2-pyridyl, and 2-thiazolyl.

$L_3$, $L_4$, $L_5$, $L_6$, $L_7$, $L_{12}$, $L_{13}$, $L_{14}$, $L_{15}$, $L_{18}$, $L_{19}$, $L_{20}$, $L_{21}$ and $L_{22}$ each independently represents a methine group. Each of these methine groups may have a substituent and examples of such substituents include a substituted or unsubstituted alkyl group having from 1 to 15, preferably from 1 to 10, more preferably from 1 to 5, carbon atoms (e.g., methyl, ethyl, 2-carboxyethyl), a substituted or unsubstituted aryl group having from 6 to 20, preferably from 6 to 15, more preferably from 6 to 10, carbon atoms (e.g., phenyl, o-carboxyphenyl), a substituted or unsubstituted heterocyclic group having from 3 to 20, preferably from 4 to 15, more preferably from 6 to 10, carbon atoms (e.g., N,N-diethylbarbituric acid), a halogen atom (e.g., chlorine, bromine, fluorine, iodine), an alkoxyl group having from 1 to 15, preferably from 1 to 10, more preferably from 1 to 5, carbon atoms (e.g., methoxy, ethoxy), an alkylthio group having from 1 to 15, preferably from 1 to 10, more preferably from 1 to 5, carbon atoms (e.g., methylthio, ethylthio), an arylthio group having from 6 to 20, preferably from 6 to 15, more preferably from 6 to 10, carbon atoms (e.g., phenylthio), and an amino group having from 0 to 15, preferably from 2 to 10, more preferably from 4 to 10, carbon atoms (e.g., N,N-diphenylamino, N-methyl-N-phenylamino, N-methylpiperazino). Each of these methine groups may form a ring together with other methine group or can form a ring together with $Z_1$, $Z_3$, $Z_4$, $Z_7$, $R_3$, $R_4$, $R_7$ and $R_9$.

$n_1$, $n_2$, $n_3$, $n_4$, $n_5$ and $n_6$ each represents 0, 1, 2, 3 or 4. $n_1$, $n_3$ and $n_5$ each preferably represents 0, 1, 2 or 3, more preferably 0 or 1, and particularly preferably 1. $n_2$, $n_4$ and $n_6$ each preferably represents 0, 1, 2 or 3, more preferably 0 or 1, and particularly preferably 0.

When $n_1$, $n_2$, $n_3$, $n_4$, $n_5$ and $n_6$ each represents 2 or more, a methine group is repeated but they are not necessary the same group.

$M_1$, $M_2$ and $M_3$ are included in the formula to show the presence of a cation or an anion when a counter ion is necessary for neutralizing an ionic charge of the dye. Representative examples of cations include an inorganic cation such as a hydrogen ion ($H^+$), an alkali metal ion (e.g., a sodium ion, a potassium ion, a lithium ion), and an alkaline earth metal ion (e.g., a calcium ion), and an organic ion such as an ammonium ion (e.g., an ammonium ion, a tetraalkylammonium ion, a pyridinium ion, an ethylpyridinium ion). Anions may be either inorganic or organic, and examples include a halogen anion (e.g., a fluorine ion, a chlorine ion, an iodine ion), a substituted arylsulfonate ion (e.g., a p-toluenesulfonate ion, a p-chlorobenzenesulfonate ion), an aryldisulfonate ion (e.g., a 1,3-benzenedisulfonate ion, a 1,5-naphthalenedisulfonate ion, a 2,6-naphthalenedisulfonate ion), an alkylsulfate ion (e.g., a methylsulfate ion), a sulfate ion, a thiocyanate ion, a perchlorate ion, a tetrafluoroborate ion, a picrate ion, an acetate ion, and a trifluoromethanesulfonate ion. In addition, ionic polymers or other dyes having a counter charge to the dye may be used.

In the present invention, a sulfo group is described as $SO_3^-$, but it can be described as $SO_3H$ when a hydrogen ion is present as a counter ion.

$m_1$, $m_2$ and $m_3$ each represents a number necessary to balance a charge in the molecule and it represents 0 when an inner salt is formed. $m_1$, $m_2$ and $m_3$ each preferably represents from 0 to 4.

At least one of $Z_1$, $Z_2$, $Z_3$, $R_1$, $R_2$, $R_3$ and $L_1$ to $L_9$ in formula (I) and at least one of $Z_4$, $Z_5$, $Z_6$, $R_4$, $R_5$, $R_6$ and $L_{10}$ to $L_{15}$ in formula (II) are substituted with a thioether group. The thioether group herein may be any thioether group. Further, the case where $Z_1$ to $Z_6$, $L_1$ to $L_{15}$ are directly substituted with an alkylthio group, an arylthio group or a heterocyclylthio group is also included.

The thioether group is represented by the following formula (X):

$$-(A_1)_{k2}-S-Q_1 \quad \text{(X)}$$

wherein $A_1$ represents an alkylene group, an alkenylene group, alkynylene group, an arylene group or a divalent heterocyclic group; $k_2$ represents 0 or 1; and $Q_1$ has the same meaning as Q.

$A_1$ represents, e.g., an alkylene group (e.g., methylene, ethylene, propylene, butylene, pentylene), an arylene group (e.g., phenylene, naphthylene), an alkenylene group (e.g., ethenylene, propenylene), an alkynylene group (e.g., ethynylene, propynylene), a heterocyclic divalent group (e.g., 6-chloro-1,3,5-triazine-2,4-diyl, pyrimidine-2,4-diyl, quinoxaline-2,3-diyl). These groups may further be substituted and the above-described V can be cited as substituents thereof.

As Q and $Q_1$, the same substituents as described as the substituents for $R_2$, etc., can be cited. Preferred examples include, for example, an unsubstituted alkyl group having from 1 to 18, preferably from 1 to 7, particularly preferably from 1 to 4, carbon atoms (e.g., methyl, ethyl, propyl, isopropyl, butyl, isobutyl, hexyl, octyl, dodecyl, octadecyl), or a substituted alkyl group having from 1 to 18, preferably from 1 to 7, particularly preferably from 1 to 4, carbon atoms [e.g., an alkyl group substituted with V, which is described above as a substituent of $Z_1$, etc., can be exemplified, preferably an aralkyl group (e.g., benzyl, 2-phenylethyl), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylcarbamoylmethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfoalkenyl group (e.g., sulfopropenyl), a sulfatoalkyl group (e.g., 2-sulfatoethyl, 3-sulfatopropyl, 4-sulfatobutyl), or a heterocyclic group-substituted alkyl group (e.g., 2-(pyrrolidin-2-one-1-yl)ethyl, tetrahydrofurfuryl)].

Further, an unsubstituted aryl group having from 6 to 20, preferably from 6 to 10, more preferably from 6 to 8, carbon atoms (e.g., phenyl, 1-naphthyl), a substituted aryl group having from 6 to 20, preferably from 6 to 10, more preferably from 6 to 8, carbon atoms (e.g., aryl groups substituted with V described as the substituent of $Z_1$, etc., specifically p-methoxyphenyl, p-methylphenyl, p-chlorophenyl), an unsubstituted heterocyclic group having from 1 to 20, preferably from 3 to 10, more preferably from 4 to 8, carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl), and a substituted heterocyclic group having from 1 to 20, preferably from 3 to 10, more preferably from 4 to 8, carbon atoms (e.g., heterocyclic groups substituted with V described as the substituent of $Z_1$, etc., specifically 5-methyl-2-thienyl, 4-methoxy-2-pyridyl) can be cited.

Q and $Q_1$ more preferably represents the above-described alkyl group or aryl group, particularly preferably the unsubstituted alkyl group (e.g., methyl, ethyl), or unsubstituted aryl group (e.g., phenyl, naphthyl), and most preferably a methyl group.

The substitution position of the thioether group represented by formula (X) is preferably $Z_1$, $Z_2$, $Z_3$, $R_1$, $R_2$, $R_3$, $Z_4$, $Z_5$, $Z_6$, $R_4$, $R_5$ or $R_6$, more preferably $Z_1$, $Z_2$, $Z_3$, $Z_4$, $Z_5$ or $Z_6$, and particularly preferably $Z_1$, $Z_2$ or $Z_3$.

$k_1$ preferably represents 1 or 2.

A heterocyclic ring represented by $Z_9$ and S—Q is most preferably represented by the following formula:

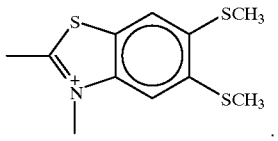

A methine compound represented by formula (III) is preferably represented by the following formula (IV):

(IV)

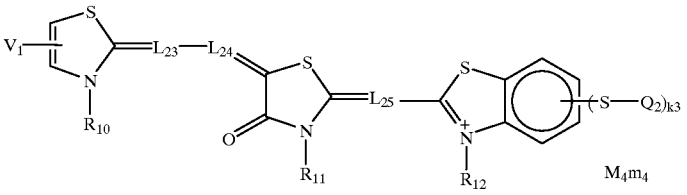

wherein $Q_2$ has the same meaning as Q; $k_3$ has the same meaning as $k_1$; $R_{10}$ has the same meaning as $R_1$; $R_{11}$ has the same meaning as $R_2$; $R_{12}$ has the same meaning as $R_3$; $L_{23}$ has the same meaning as $L_3$; $L_{24}$ has the same meaning as $L_4$; $L_{25}$ has the same meaning as $L_5$; $M_4$ has the same meaning as $M_1$; $m_4$ has the same meaning as $m_1$; and $V_1$ represents a monovalent substituent and the same groups as the above-described V can be cited.

Specific examples of methine compounds represented by formulae (I), (II), (III) and (IV) are shown below but the present invention is not limited thereto.

(1)

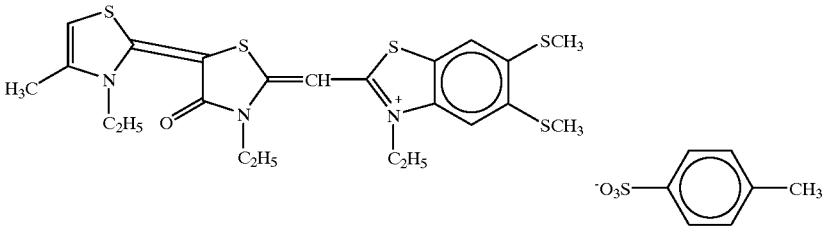

(2)

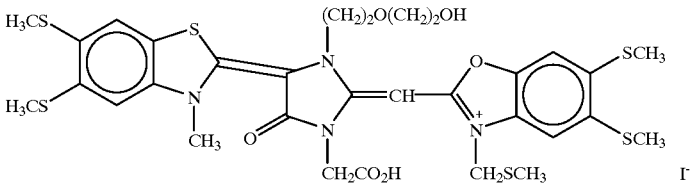

-continued
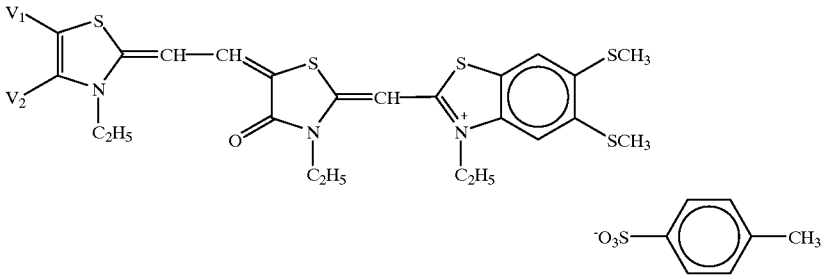
(3)
$V_1 = H_1$, $V_2 = CH_3$
(4)
$V_1, V_2 =$ —$(CH_2)_4$—
(5)
$V_1, V_2 =$ —$(CH_2)_3$—
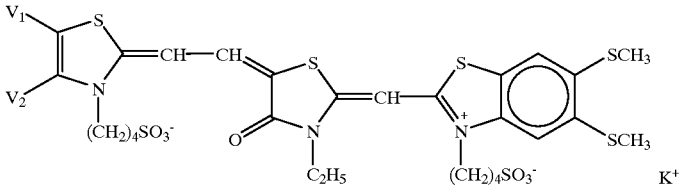
(6)
$V_1 = H_1$, $V_2 = CH_3$
(7)
$V_1, V_2 =$ —$(CH_2)_4$—
(8)
$V_1, V_2 =$ —$(CH_2)_3$—
(9)
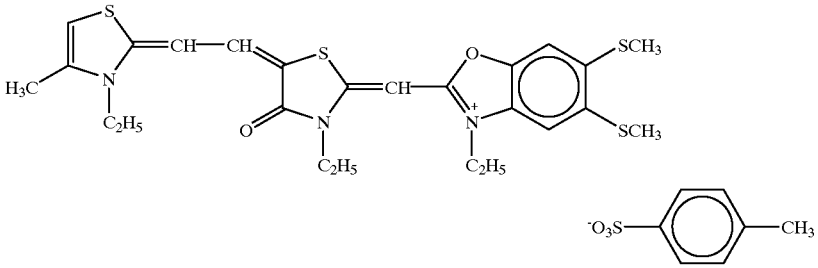
(10)
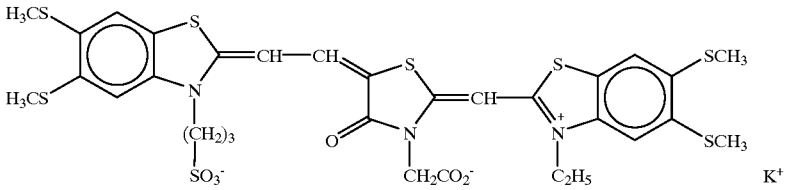
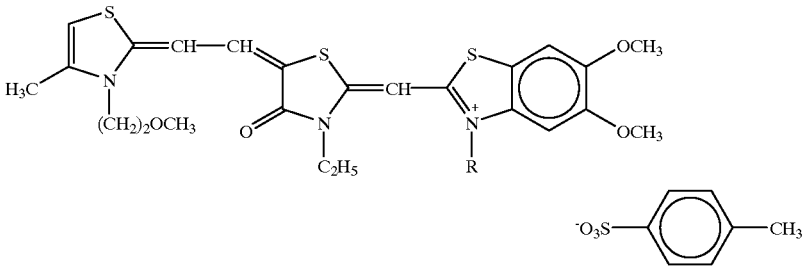
(11)
R = —$(CH_2)_2$—S—$CH_3$ -continued
(12)
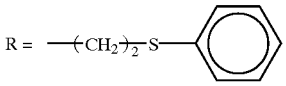
(13)
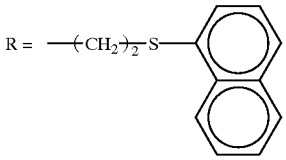
(14)
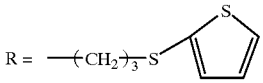
(15)
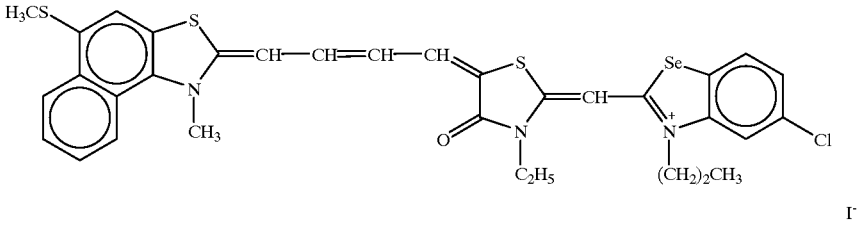
(16)
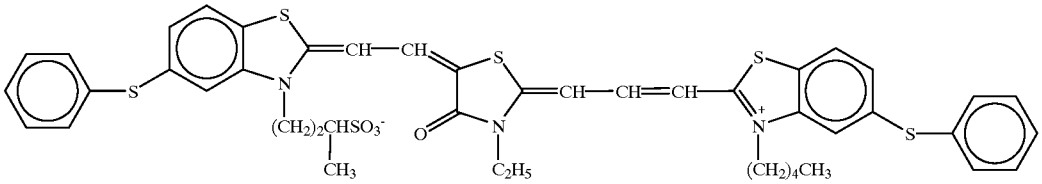
(17)
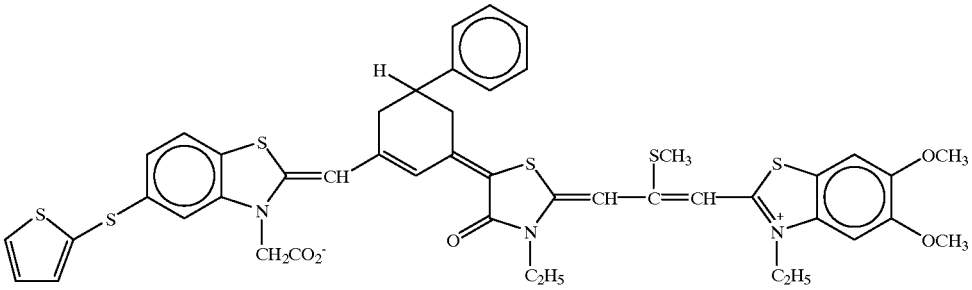
(18)
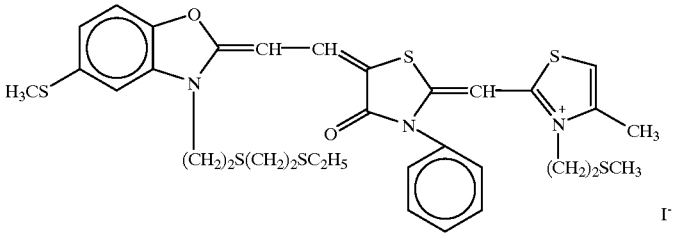

-continued
(19)
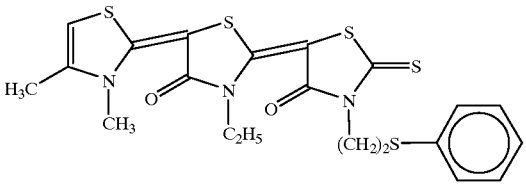
(20)
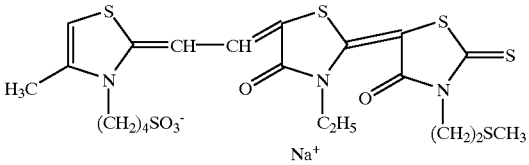
(21)
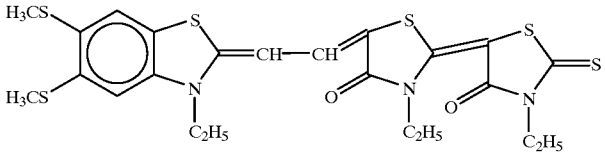
(22)
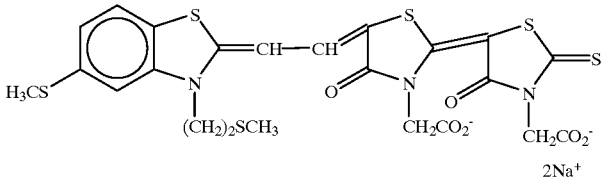
(23)
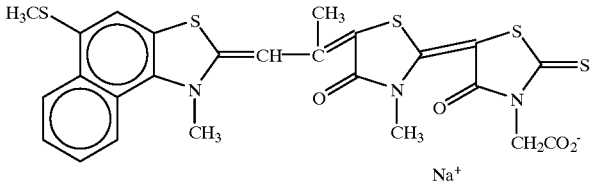
(24)
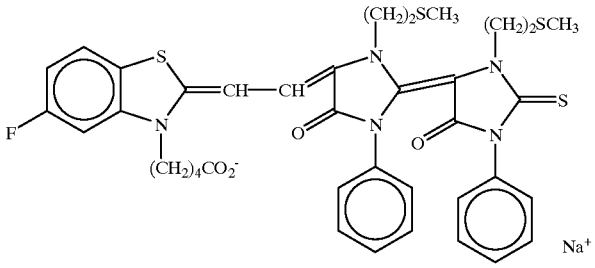
(25)
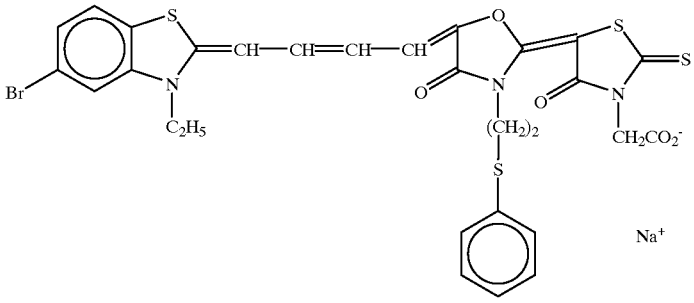

-continued (26)

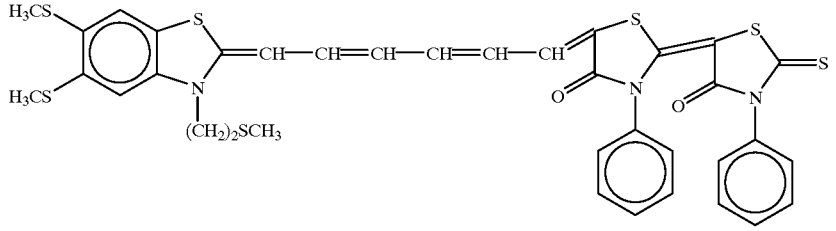

Compounds represented by formulae (I), (II), (III) and (IV) according to the present invention can be synthesized according to the methods described in F. M. Harmer, *Heterocyclic Compounds—Cyanine Dyes and Related Compounds*, John Wiley & Sons, New York, London (1964), D. M. Sturmer, *Heterocyclic Compounds—Special Topics in Heterocyclic Chemistry*, Chap. 18, Clause 14, pp. 482 to 515, John Wiley & Sons, New York, London (1977), *Rodd's Chemistry of Carbon Compounds,* 2nd Ed., Vol. IV, Part B, Chap. 15, pp. 369 to 422, Elsevier Science Publishing Company Inc., New York (1977) and the like.

Synthesis Example 1

Synthesis of Compound (3)

Compound (3) was synthesized according to the following reaction scheme.

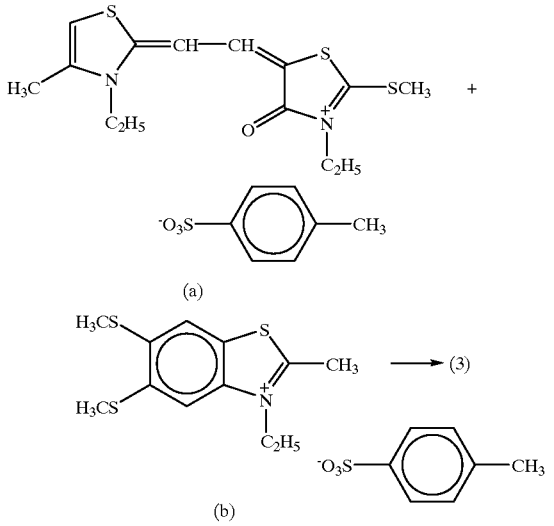

Zero point five (0.5) ml of triethylamine was added to 0.9 g (0.0018 mol) of (a) and 0.8 g (0.0018 mol) of (b), and stirred with heating on a water bath of 80° C. for 30 minutes. The reaction solution was cooled with water while stirring, and crystals were filtered off by suction filtration. The crystals obtained were dissolved by reflux with heating in a mixed solvent of 50 ml/50 ml of methanol/chloroform, and after natural filtration, 50 ml of the solvent was distilled off. After being allowed to stand, the precipitated crystals were recovered by suction filtration and dried under reduced pressure.

Compound (3): a blue powder, yield by volume: 87 g, yield: 67%, λmax: 661 nm, ε: 94,300 (methanol), melting point: 250° C. or more.

Any of silver chloride, silver bromide, silver chlorobromide, silver chloroiodobromide or silver iodobromide can be used as silver halide in the silver halide emulsion according to the present invention, but the content of silver chloride is preferably 30 mol % or more, more preferably 50 mol % or more and the content of silver iodide is preferably 5 mol % or less, more preferably 2 mol % or less.

The form of the silver halide grain may be any of a cubic, tetradecahedral, octahedral, amorphous or plate-like form, but a cubic or plate-like form is preferred.

The photographic emulsions which are used in the present invention can be prepared according to the methods disclosed in P. Glafkides, *Chimie et Physique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964) and so on.

That is, any of an acid process, a neutral process, etc., may be used but the emulsions are preferably prepared under acidic conditions. Any of a single jet method, a double jet method and a combination of these methods can be used for the reaction of a soluble silver salt with a soluble halogen salt.

A method in which grains are formed in the presence of excess silver ions (a so-called reverse mixing method) can also be used. A method in which the pAg in the liquid phase in which the silver halide is formed is kept constant, that is, the controlled double jet method, can also be used as one type of the double jet method. In addition, the grain formation is preferably carried out using a silver halide solvent such as ammonia, thioether, or tetra-substituted thiourea. More preferred are tetra-substituted thiourea compounds and they are disclosed in JP-A-53-82408 and JP-A-55-77737. Preferred thiourea compounds are tetramethylthiourea and 1,3-dimethyl-2-imidazolidinethione. The addition amount of a silver halide solvent varies according to the kind of the compound used and the objective grain size and halogen composition but is preferably from $2\times10^{-5}$ to $1\times10^{-2}$ mol per mol of silver halide.

Silver halide emulsions with a regular crystal form and a narrow grain size distribution can easily be obtained by the controlled double jet method and the grain formation method using silver halide solvents, which is effective to prepare the silver halide emulsion for use in the present invention.

Moreover, the method in which the rates of addition of the silver nitrate and the alkali halide are varied according to the grain growth rate as disclosed in British Patent 1,535,016, JP-B-48-36890 (the term "JP-B" as used herein means an "examined Japanese patent publication") and JP-B-52-16364, and the method in which the concentrations of the aqueous solutions are varied as disclosed in British Patent 4,242,445 and JP-A-55-158124 are preferably and effectively used to rapidly grow grains within the range not exceeding the critical degree of saturation in order to provide uniform grain size.

Emulsions for use in the present invention are preferably monodisperse emulsions having the variation coefficient represented by the equation [(standard deviation of grain sizes)/(average grain size)]×100 of 20% or less, more preferably 15% or less.

The average grain size of silver halide emulsion grains is preferably 0.5 μm or less, more preferably from 0.08 to 0.4 μm.

Silver halide emulsions for use in the present invention may contain metals belonging to Group VIII of the Periodic Table. It is preferred to contain a rhodium compound, an iridium compound, a ruthenium compound, a rhenium compound, chromium compound, etc., for attaining high contrast and low fog. Preferred as these heavy metals are metal coordination complexes having six ligands represented by the following formula:

$$[M(NY)_mL_{6-m}]^n$$

wherein M represents a heavy metal selected from Ir, Ru, Rh, Re and Cr, L represents a crosslinking ligand, Y represents oxygen or sulfur, m represents 0, 1 or 2, and n represents 0, 1-, 2- or 3-.

Preferred examples of L include a halide ligand (e.g., fluoride, chloride, bromide, iodide), a cyanide ligand, a cyanate ligand, a thiocyanate ligand, a selenocyanate ligand, a tellurocyanate ligand, an acid ligand and aquo ligand. When an aquo ligand is present, it is preferred for an aquo ligand to occupy one or two ligands.

It is preferred for contain iron compounds for higher sensitization and particularly preferred are metal coordination complexes having a cyan ligand.

These compounds are dissolved in water or an appropriate solvent and used. A conventional method such as a method in which an aqueous solution of hydrogen halide (e.g., hydrochloric acid, hydrobromic acid, hydrofluoric acid) or alkali halide (e.g., KCl , NaCl, KBr, NaBr) is added to stabilize the solution of the compound can be used. It is also possible to include and dissolve other silver halide grains which have been previously doped with these compounds.

Specific examples of metal coordination complexes are shown below.

1. $[Rh(H_2O)Cl_5]^{2-}$
2. $[RuCl_6]^{3-}$
3. $[Ru(NO)Cl_5]^{2-}$
4. $[RhCl_6]^{3-}$
5. $[Ru(H_2O)Cl_5]^{2-}$
6. $[Ru(NO)(H_2O)Cl_4]^{-}$
7. $[Ru_2Cl_{10}O]^{2-}$
8. $[Re(NO)Cl_5]^{2-}$
9. $[Ir(NO)Cl_5]^{2-}$
10. $[Ir(H_2O)Cl_5]^{2-}$
11. $[Re(H_2O)Cl_5]^{2-}$
12. $[RhBr_6]^{3-}$
13. $[ReCl_6]^{3-}$
14. $[IrCl_6]^{3-}$
15. $[Re(NS)Cl_4(SeCN)]^{2-}$
16. $[Cr(CN)_6]^{3-}$
17. $[Fe(CN)_6]^{3-}$

The addition amount of these compounds is from $1\times10^{-8}$ to $1\times10^{-2}$ mol, preferably from $5\times10^{-8}$ to $2\times10^{-4}$ mol, per mol of the silver in the silver halide emulsion.

These compounds can be added optionally during the preparation of silver halide emulsion grains and at any stage prior to coating of the emulsion, but they are particularly preferably added during emulsion formation and incorporated into the silver halide grains.

The silver halide emulsion of the present invention is preferably chemically sensitized. Conventionally known chemical sensitization methods such as sulfur sensitization, selenium sensitization, tellurium sensitization and noble metal sensitization can be used alone or in combination. When sensitization is conducted in combination, a combination of sulfur sensitization and gold sensitization, a combination of sulfur sensitization, selenium sensitization and gold sensitization, and a combination of sulfur sensitization, tellurium sensitization and gold sensitization are preferred, for example.

The sulfur sensitization for use in the present invention is usually carried out by adding a sulfur sensitizer and stirring the emulsion at high temperature of 40° C. or more for a certain period of time. Various known sulfur compounds can be used as a sulfur sensitizer, for example, in addition to sulfur compounds contained in gelatin, various sulfur compounds, e.g., thiosulfates, thioureas, thiazoles, and rhodanines. Further, sulfur sensitizers disclosed in U.S. Pat. Nos. 1,574,944, 2,410,689, 2,278,947, 2,728,668, 3,501,313, 3,656,955, German Patent 1,422,869, JP-B-56-24937 and JP-A-55-45016 can also be used. Preferred sulfur compounds are thiosulfates and thioureas. The addition amount of a sulfur sensitizer is varied in accordance with various conditions such as the pH and temperature during chemical ripening and the grain size of the silver halide grains, but is preferably from $10^{-7}$ to $10^{-2}$ mol and more preferably from $10^{-5}$ to $5\times10^{-4}$ mol, per mol of the silver halide.

Various known selenium compounds can be used as a selenium sensitizer in the present invention. The selenium sensitization is usually carried out by adding unstable and/or non-unstable selenium compounds and stirring the emulsion at high temperature, preferably 40° C. or more, for a certain period of time. The compounds disclosed in JP-B-44-15748, JP-B-43-13489, Japanese Patent Application Nos. 2-130976 (JP-A-4-25832), 2-229300 (JP-A-4-109240) and 3-121798 (JP-A-4-324855) can be used as unstable selenium compounds. The compounds represented by formulae (VIII) and (IX) disclosed in Japanese Patent Application No. 3-121798 (JP-A-4-324855) are particularly preferably used.

A low decomposition active selenium compound can also be preferably used. A low decomposition active selenium compound is a selenium compound whose half life is 6 hours or more when a mixed solution (pH: 6.3) of 10 mmol of $AgNO_3$, 0.5 mmol of the selenium compound, 40 mmol of 2-(N-morpholino)ethane sulfonic acid buffer water/1,4-dioxane (volume ratio: 1/1) is reacted at 40° C. Compounds SE-1 to SE-10 disclosed in Japanese Patent Application No. 7-288104 are preferably used as a low decomposition active selenium compound.

The tellurium sensitizer for use in the present invention is a compound which forms silver telluride, which is presumed to become sensitization speck, in the surfaces or interiors of silver halide grains. The formation rate of the silver telluride in the silver halide emulsion can be examined according to the method disclosed in Japanese Patent Application No. 4-146739 (JP-A-5-313284).

Specific examples of tellurium sensitizers which can be used in the present invention are those disclosed in the following patents and literature: U.S. Pat. Nos. 1,623,499, 3,320,069, 3,772,031, British Patents 235,211, 1,121,496, 1,295,462, 1,396,696, Canadian Patent 800,958, Japanese Patent Application Nos. 2-333819, 3-53693 (JP-A-4-271341), 3-131598 (JP-A-4-333043), 4-129787 (JP-A-5-

303157), *J. Chem. Soc. Chem. Commun.,* 635 (1980), ibid., 1102 (1979), ibid., 645 (1979), *J. Chem. Soc. Perkin. Trans.,* 1, 2191 (1980), S. Patai compiled, *The Chemistry of Organic Selenium and Tellurium Compounds*, Vol. 1 (1986), and ibid., Vol. 2 (1987). The compounds represented by formulae (II), (III) and (IV) disclosed in Japanese Patent Application No. 4-146739 (JP-A-5-313284) are particularly preferred.

The amount of the selenium and tellurium sensitizers to be used in the present invention varies according to the silver halide grains used and the conditions of chemical ripening, but is generally from $10^{-8}$ to $10^{-2}$ mol or so, preferably from $10^{-7}$ to $5\times10^{-4}$ mol or so, per mol of silver halide. There is no particular limitation on the conditions of chemical sensitization in the present invention, but pH is from 5 to 8, pAg is from 6 to 11, preferably from 7 to 10, and temperature is from 40 to 95° C., preferably from 45 to 85° C.

The noble metal sensitizers which are used in the present invention include gold, platinum, palladium and iridium, and gold sensitization is particularly preferred. The oxidation number of the gold in the gold sensitizer for use in the present invention may be either +1 valent or +3 valent, and specific examples of gold sensitizers include chloroaurate, potassium chloroaurate, auric trichloride, potassium auric thiocyanate, potassium iodoaurate, tetracyanoauric acid, ammonium aurothiocyanate, pyridyl trichlorogold and gold sulfide, and the amount of about $10^{-7}$ to $10^{-2}$ mol per mol of silver halide can be used.

Cadmium salt, sulfite, lead salt and thallium salt may be coexist in the silver halide emulsion for use in the present invention in the process of the formation or physical ripening of silver halide grains.

Reduction sensitization can be used in the present invention. As reduction sensitizers there may be used stannous salt, amines, formamidinesulfinic acid, and silane compounds.

Thiosulfonic acid compounds may be added to the silver halide emulsion of the present invention according to the method disclosed in European Patent 293917. The addition amount of a thiosulfonic acid compound is varied in a wide range in accordance with various conditions such as the pH, temperature and the grain size of the silver halide grains, but is preferably from $1\times10^{-7}$ to $5\times10^{-2}$ mol per mol of silver halide.

The silver halide emulsion in the photographic material of the present invention may be one kind, or two or more kinds of silver halide emulsions (for example, those differing in average grain sizes, differing in halogen compositions, differing in crystal habits, or differing in chemical sensitization conditions) may be used in combination.

For the inclusion of the methine compound represented by formula (I), (II), (III) or (IV) of the present invention in the silver halide emulsion, they may be directly dispersed in the emulsion, or they may be dissolved in water, a single or mixed solvent of methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide, etc., then added to the emulsion.

In addition, various methods can be used for including dyes in the emulsion, for example, a method in which dyes are dissolved in a volatile organic solvent, the solution is dispersed in water or hydrophilic colloid and this dispersion is added to the emulsion as disclosed in U.S. Pat. No. 3,469,987, a method in which water-insoluble dyes are dispersed in a water-soluble solvent without being dissolved and this dispersion is added to the emulsion as disclosed in JP-B-46-24185, a method in which dyes are dissolved in acid and this solution is added to the emulsion, or dyes are added to the emulsion as an aqueous solution coexisting with acid or base as disclosed in JP-B-44-23389, JP-B-44-27555 and JP-B-57-22091, a method in which dyes are added to the emulsion as an aqueous solution or colloidal dispersion coexisting with a surfactant as disclosed in U.S. Pat. Nos. 3,822,135 and 4,006,026, a method in which dyes are directly dispersed in a hydrophilic colloid and the dispersion is added to the emulsion as disclosed in JP-A-53-102733 and JP-A-58-105141, or a method in which dyes are dissolved using a compound capable of red-shifting and the solution is added to the emulsion as disclosed in JP-A-51-74624 can be used. Further, ultrasonic waves can be used for dissolution.

The time of the addition of the methine compound for use in the present invention to the silver halide emulsion of the present invention may be at any stage of the preparation of the emulsion recognized as useful hitherto. For example, they may be added at any stage if it is before coating, i.e., before grain formation stage of silver halide grains or/and before desalting stage, during desalting stage and/or after desalting and before beginning of chemical ripening, as disclosed in U.S. Pat. Nos. 2,735,766, 3,628,960, 4,183,756, 4,225,666, JP-A-58-184142 and JP-A-60-196749, or immediately before or during chemical ripening, after chemical ripening and before coating as disclosed in JP-A-58-113920. Also, as disclosed in U.S. Pat. No. 4,225,666 and JP-A-58-7629, the sensitizing dyes can be used as a single compound alone or in combination with compounds having different structures, and they can be divided and added separately, for example, one part of them is added during grain formation stage and the remaining is added during chemical ripening or after the completion of chemical ripening, otherwise one part is added prior to chemical ripening or during ripening stage and the remaining after completion of chemical ripening. The kinds of compounds added separately and combinations of compounds may be varied.

The amount of the compound represented by formula (I), (II), (III) or (IV) varies in accordance with the shape and the size of silver halide grains, but is from 0.1 to 4 mmol, preferably from 0.2 to 2.5 mmol, per mol of silver halide. Other sensitizing dyes can be used in combination.

The silver halide emulsion produced according to the present invention can be used in a color photographic material and a black-and-white photographic material. As a color photographic material, in particular, color papers, color films for general photographing, color reversal films, and as a black-and-white photographic material, X-ray films, films for general photographing, photographic films for printing can be cited.

The exposure method of silver halide photographic materials of the present invention is described below. Photographic images can be obtained by ordinary exposure methods. That is, various known light sources, e.g., natural light (daylight), a tungsten lamp, a fluorescent lamp, a mercury lamp, a xenon arc lamp, a carbon arc lamp, a xenon flash lamp, a laser light, an emitting diode, CRT, etc., can be used. Exposure time shorter than $1/1{,}000$ sec., e.g., $1/10^4$ to $1/10^6$ sec. by a xenon flash lamp and longer than 1 sec. can be used in addition to exposure time of from $1/1{,}000$ sec. to 1 sec. by ordinary cameras. If necessary, spectral composition of light for exposure can be controlled using a color filter. Exposure can be performed by light released from phosphors excited by an electron beam, an X-ray, a γ-ray, an α-ray, etc.

Laser light sources and light emitting diode light sources are preferably used in the present invention.

There are several kinds of laser lights, e.g., those making use of helium-neon gas, argon gas, krypton gas, and carbon dioxide gas as a laser oscillating medium, those using a solid, e.g., ruby and cadmium, as an oscillator, and a liquid laser and a semiconductor laser. As such laser lights are coherent lights having sharp directional property of uniform phase of single frequency, different from general lights for illumination, etc., it is necessary for a silver halide photographic material to be exposed to have spectral characteristics coincide with oscillating wavelength of the laser to be used as a light source.

Many light emitting diodes (LED) are used which have various light emission center wavelengths and emitting efficiencies depending upon the LED materials constituting the element and the compositions and structures of the substrate materials. Examples of light emitting diodes having a light emission center wavelength in a visible region include GaP/GaP (555 nm), GaP:N/GaP (565 nm), GaAs 0.15 P 0.85:N/GaP (585 nm), GaAs 0.25 P 0.75:N/GaP (610 nm), GaAs 0.35 P 0.65:N/GaP (630 nm), GaAs 0.6 P 0.4:N/GaAs (650 nm), GaAlAs:DH/GaAlAs (660 nm), GaP:Zn, O/GaP (700 nm), etc. As the half value width of emitting spectra of these light emitting diodes is around 40 nm, it is necessary for a silver halide photographic material to be exposed to have spectral characteristics coincide with light emitting wavelength of the light emitting diode to be used.

A laser light source having an oscillating wavelength between 620 and 690 nm is preferred as exposure light source for the silver halide photographic material of the present invention, and more preferred are a He—Ne laser, a semiconductor laser having an oscillating wavelength around 670 nm, and a light emitting diode having light emitting wavelength between 620 and 690 nm.

The processing method of the silver halide photographic material of the present invention is described below. In photographic processing of photographic materials of the present invention, any known method can be used and any known processing solution can be used. The processing temperature is selected generally between 18° C. and 50° C. but temperatures lower than 18° C. or higher than 50° C. can also be used. According to purposes, both development processing for forming a silver image (black-and-white photographic processing) and color photographic processing comprising development processing for forming a dye image can be applied. In a black-and-white developing solution, known developing agents such as dihydroxybenzenes (e.g., hydroquinone), 3-pyrazolidones (e.g., 1-phenyl-3-pyrazolidone, 4-hydroxymethyl-4-methyl-1-phenyl-3-pyrazolidone), aminophenols (e.g., N-methyl-p-aminophenol) and isoascorbates (e.g., sodium erythorbate) can be used alone or in combination.

A color developing solution generally comprises an alkaline aqueous solution containing a color developing agent. As a color developing agent, conventionally known aromatic primary amine color developing agents can be used, for example, phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline).

In addition to the above, those disclosed in L. F. A. Mason, *Photographic Processing Chemistry*, Focal Press, pp. 226 to 229 (1966), U.S. Pat. Nos. 2,193,015, 2,592,364, and JP-A-48-64933 may be used.

A developing solution can contain a pH buffer such as alkali metal sulfite, carbonate, borate and phosphate, or a development inhibitor or an antifoggant such as bromide, iodide, and an organic antifoggant. A developing solution may also contain, if necessary, a water softener, a preservative such as hydroxylamine, an organic solvent such as benzyl alcohol and diethylene glycol, a development accelerator such as polyethylene glycol, quaternary ammonium salt, and amines, a dye-forming coupler, a competitive coupler, a fogging agent such as sodium boronhydride, an auxiliary developing agent such as 1-phenyl-3-pyrazolidone, a thickener, polycarboxylic acid chelating agents disclosed in U.S. Pat. No. 4,083,723, or antioxidants disclosed in West German Patent (OLS) No. 2,622,950.

When color photographic processing is conducted, a photographic material is generally bleaching processed after being color development processed. A bleaching process and a fixing process may be carried out at the same time or may be performed separately. Compounds of polyvalent metals such as iron(III), cobalt(III), chromium(VI), copper(II), etc., peracids, quinones, and nitroso compounds are used as a bleaching agent. For example, bleaching agents which can be used include a complex salt such as an organic complex salt of ferricyanide, bichromate, iron(III) or cobalt(III) with aminopolycarboxylic acids, e.g., ethylenediaminetetraacetic acid, nitrilotriacetic acid, and 1,3-diamino-2-propanoltetraacetic acid, or citric acid, tartaric acid, malic acid, or persulfate, permanganate or nitrosophenol. The use of potassium ferricyanide, sodium ethylenediaminetetraacetic acid iron(III) complex salt and ammonium ethylenediaminetetraacetic acid iron(III) complex salt is preferred above all. Ethylenediaminetetraacetic acid iron(III) complex salt is useful in a bleaching solution or a monobath blixing solution.

A bleaching solution or a blixing solution can contain various additives in addition to bleaching accelerators disclosed in U.S. Pat. Nos. 3,642,520, 3,241,966, JP-B-45-8506, and JP-B-45-8836 and thiol compounds disclosed in JP-A-53-65732. Further, the photographic material of the present invention may be subjected to washing process or may be processed with a stabilizing solution without employing a washing step after bleaching or blixing step.

More preferred is the case where the methine compound represented by formula (I), (II), (III) or (IV) according to the present invention is used in a black-and-white silver halide photographic material and processed with an automatic processor, pH of the developing solution in development processing is 11.5 or less, and the replenishing rate of the developing solution and the fixing solution of the automatic processor is respectively from 10 to 500 ml/m$^2$, particularly preferably from 20 to 200 ml/m$^2$. The developing machine is disclosed in JP-A-4-369643.

The present invention is described in detail below with reference to the specific examples, but the present invention should not be construed as being limited thereto.

EXAMPLE 1

| Preparation of Emulsion A | |
|---|---|
| Solution 1 | |
| Water | 1 liter |
| Gelatin | 20 g |
| Sodium Chloride | 3.0 g |
| 1,3-Dimethylimidazolidine-2-thione | 20 mg |
| Sodium Benzenethiosulfonate | 8 mg |

-continued

| Preparation of Emulsion A | |
|---|---|
| Solution 2 | |
| Water | 400 ml |
| Silver Nitrate | 100 g |
| Solution 3 | |
| Water | 400 ml |
| Sodium Chloride | 27.1 g |
| Potassium Bromide | 21.0 g |
| Ammonium Hexachloroiridate (III) (0.001% aqueous solution) | 20 ml |
| Potassium Hexachlororhodate (III) (0.001% aqueous solution) | 6 ml |

Solution 2 and Solution 3 were simultaneously added to Solution 1 maintained at 42° C. and pH 4.5 over a period of 15 minutes with stirring, and nucleus grains were formed. Subsequently, Solution 4 and Solution 5 shown below were added over a period of 15 minutes. Further, 0.15 g of potassium iodide was added thereto and grain formation was terminated.

| | |
|---|---|
| Solution 4 | |
| Water | 400 ml |
| Silver Nitrate | 100 g |
| Solution 5 | |
| Water | 400 ml |
| Sodium Chloride | 27.1 g |
| Potassium Bromide | 21.0 g |
| Potassium Hexacyanoferrate (II) (0.1% aqueous solution) | 10 ml |

The mixture was then washed according to an ordinary flocculation method and 40 g of gelatin was added.

The pH and pAg were adjusted to 5.7 and 7.5, respectively, and 1.0 mg of sodium thiosulfate, 4.0 mg of chloroauric acid, 1.5 mg of triphenylphosphine selenide, 8 mg of sodium benzenethiosulfonate, and 2 mg of sodium benzenethiosulfinate were added thereto and optimal chemical sensitization was carried out at 55° C.

Further, 100 mg of 4-hydroxy-6-methyl-1,3,3a,7-tetraazaindene as a stabilizer and phenoxyethanol as a preservative were added to finally obtain cubic silver chloroiodobromide Emulsion A having a silver chloride content of 70 mol % and an average grain size of 0.25 $\mu$m.

Preparation of Coated Sample

To Emulsion A were added the compound shown in Table 1 in an amount of $3.8\times10^{-4}$ mol/mol Ag and spectral sensitization was conducted. Further, KBr in an amount of $3.4\times10^{-4}$ mol/mol Ag, Compound (1) in an amount of $3.2\times10^{-4}$ mol/mol Ag, Compound (2) in an amount of $8.0\times10^{-4}$ mol/mol Ag, hydroquinone in an amount of $1.2\times10^{-2}$ mol/mol Ag, citric acid in an amount of $3.0\times10^{-3}$ mol/mol Ag, Compound (3) in an amount of $1.0\times10^{-4}$ mol/mol Ag, Compound (4) in an amount of $6.0\times10^{-4}$ mol/mol Ag, 35 wt %, based on gelatin, of polyethyl acrylate latex, 20 wt %, based on gelatin, of colloidal silica having a particle size of 10 m$\mu$, and 4 wt %, based on gelatin, of Compound (5) were added thereto. The thus-obtained coating solution was coated on a polyester support to provide a coated silver weight of 3.7 g/m$^2$ and a coated gelatin weight of 1.6 g/m$^2$. An upper protective layer and a lower protective layer each having the composition shown below were coated on this support and a UL layer having the composition shown below was coated beneath the lower protective layer.

| | |
|---|---|
| Upper Protective Layer | |
| Gelatin | 0.3 g/m$^2$ |
| Silica Matting Agent (average particle size: 3.5 $\mu$m) | 25 mg/m$^2$ |
| Compound (6) (gelatin dispersion) | 20 mg/m$^2$ |
| Colloidal Silica (particle size: 10 to 20 $\mu$m) | 30 mg/m$^2$ |
| Compound (7) | 5 mg/m$^2$ |
| Sodium Dodecylbenzenesulfonate | 20 mg/m$^2$ |
| Compound (8) | 20 mg/m$^2$ |
| Lower Protective Layer | |
| Gelatin | 0.5 g/m$^2$ |
| Compound (9) | 15 mg/m$^2$ |
| 1,5-Dihydroxy-2-benzaldoxime | 10 mg/m$^2$ |
| Polyethyl Acrylate Latex | 150 mg/m$^2$ |
| UL Layer | |
| Gelatin | 0.5 g/m$^2$ |
| Polyethyl Acrylate Latex | 150 mg/m$^2$ |
| Compound (5) | 40 mg/m$^2$ |
| Compound (10) | 10 mg/m$^2$ |

The support of the sample which was used in the present invention had the backing layer and the conductive layer having the following compositions.

| | |
|---|---|
| Backing Layer | |
| Gelatin | 3.3 g/m$^2$ |
| Sodium Dodecylbenzenesulfonate | 80 mg/m$^2$ |
| Compound (11) | 40 mg/m$^2$ |
| Compound (12) | 20 mg/m$^2$ |
| Compound (13) | 90 mg/m$^2$ |
| 1,3-Divinylsulfonyl-2-propanol | 60 mg/m$^2$ |
| Polymethyl Methacrylate Fine Particles (average particle size: 6.5 $\mu$m) | 30 mg/m$^2$ |
| Compound (5) | 120 mg/m$^2$ |
| Conductive Layer | |
| Gelatin | 0.1 g/m$^2$ |
| Sodium Dodecylbenzenesulfonate | 20 mg/m$^2$ |

-continued
| | |
|---|---|
| $SnO_2/Sb$ (9/1 by weight, average grain size: 0.25 μm) | 200 mg/m$^2$ |
Compound (1)
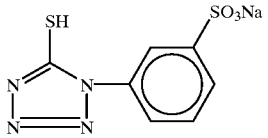
Compound (2)
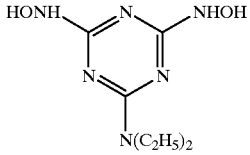
Compound (3)
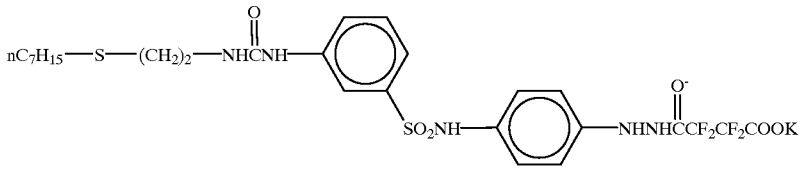
Compound (4)
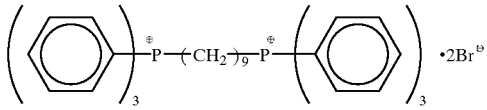
Compound (5)
A 3/1 mixture of n = 2/n = 3
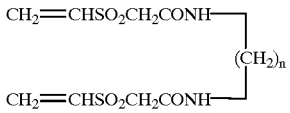
Compound (6)
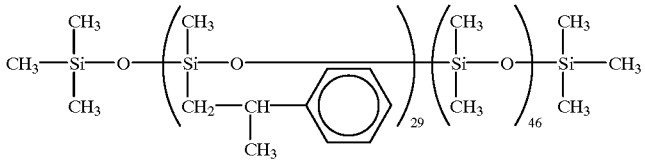
Compound (7)
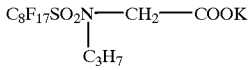
Compound (8)
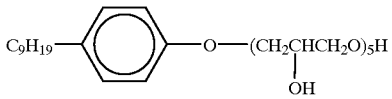
Comparative Dye
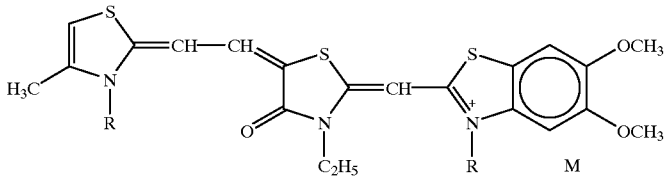
S-1
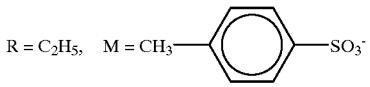
S-2

-continued
R = $(CH_2)_4SO_3^-$, M = $K^+$
S-3
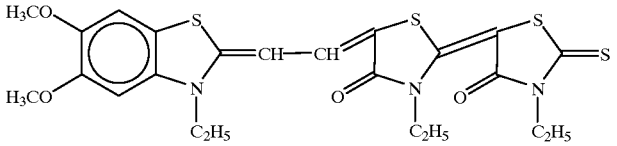
Compound (9)
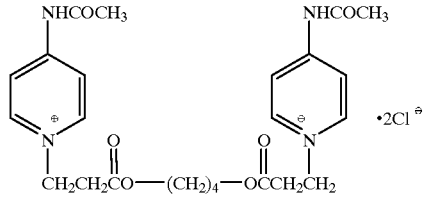
Compound (10)
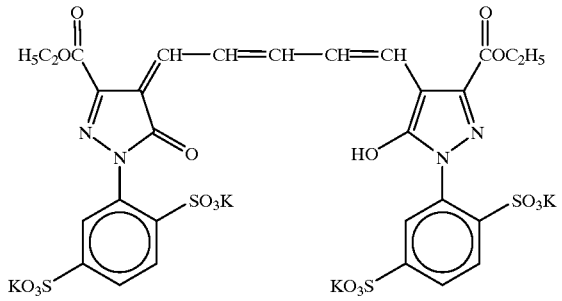
Compound (11)
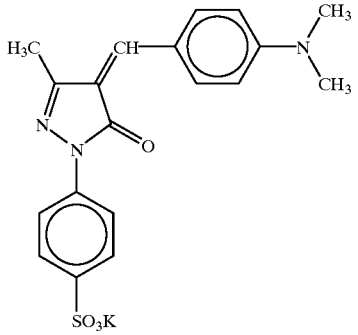
Compound (12)
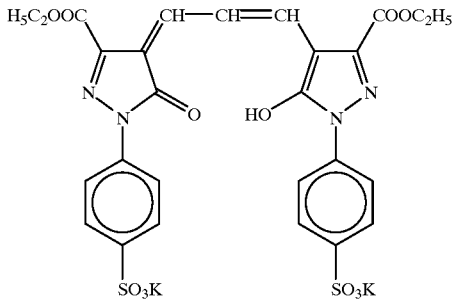
Compound (13)

-continued

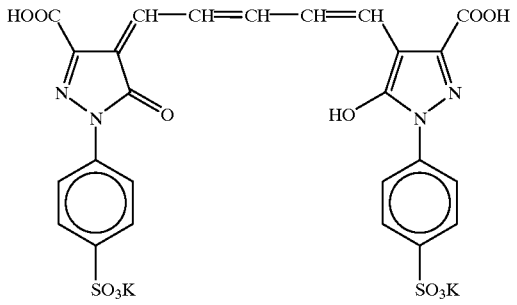

TABLE 1

| Sample | | Fresh | | After Storage | | |
|---|---|---|---|---|---|---|
| No. | Dye | Sensitivity | Fog | Sensitivity | Fog | Remarks |
| 1-1 | S-1 | 100 (control) | 0.06 | 65 | 0.10 | Comparison |
| 1-2 | (12) | 120 | 0.05 | 102 | 0.06 | Invention |
| 1-3 | (3) | 141 | 0.04 | 131 | 0.04 | Invention |
| 1-4 | S-2 | 98 | 0.06 | 63 | 0.11 | Comparison |
| 1-5 | (6) | 138 | 0.05 | 125 | 0.05 | Invention |
| 1-6 | S-3 | 93 | 0.07 | 53 | 0.12 | Comparison |
| 1-7 | (21) | 123 | 0.05 | 105 | 0.05 | Invention |

Each of the above produced samples was exposed with xenon flash light of emission time of $10^{-5}$ sec. through an interference filter which had a peak at 633 nm and through a continuous wedge, and sensitometry was conducted using an automatic processor FG-710S (a product of Fuji Photo Film Co., Ltd.) by the condition shown in Table 2.

Sensitivity is a reciprocal of the exposure amount giving density of 1.5 and the relative sensitivity of each sample $S_{1.5}$ was calculated taking the sensitivity of comparative sample as 100. The bigger the value, the higher is the sensitivity.

Besides, unexposed film was stored at 60% RH, 60° C. for seven days, then exposed, development processed and sensitivity was evaluated in the same manner. The results obtained are shown in Table 1.

TABLE 2

Processing Time of Each Step of FG710S

| Step | Temperature (° C.) | Time (sec) |
|---|---|---|
| Insertion | | 2 |
| Development | 38 | 16 |
| Fixation | 37 | 16 |
| Washing | 26 | 9 |
| Squeegeeing | | 3 |
| Drying | 55 | 15 |
| Total | | 61 |

The compositions of developing solution and the fixing solution used are shown in Tables 3 and 4.

TABLE 3

| Composition of Developing Solution | |
|---|---|
| Sodium 1,2-dihydroxybenzene-3,5-disulfonate | 0.5 g |
| Diethylenetriaminepentaacetic acid | 2.0 g |
| Sodium carbonate | 5.0 g |
| Boric acid | 10.0 g |
| Potassium sulfite | 85.0 g |
| Sodium bromide | 6.0 g |
| Diethylene glycol | 40.0 g |
| 5-Methylbenzotriazole | 0.2 g |
| Hydroquinone | 30.0 g |
| 4-Hydroxymethyl-4-methyl-1-phenyl-3-pyrazolidone | 1.6 g |
| 2,3,4,5,7,8-Hexahydro-2-thioxo-4-(1H)-quinazoline | 0.05 g |
| Sodium 2-mercaptobenzimidazole-5-sulfonate | 0.3 g |

Water was added to make 1 liter and pH was adjusted to 10.7 with potassium hydroxide

TABLE 4

| Composition of Fixing Solution | |
|---|---|
| Sodium thiosulfate (anhydrous) | 150 g |
| Compound (K) | 0.1 mol |
| Sodium bisulfite | 30 g |
| Disodium ethylenediaminetetraacetate dihydrate | 25 g |

Water was added to make 1 liter and pH was adjusted to 6.0 with sodium hydroxide As is apparent from the results in Table 1, the dyes according to the present invention exhibit high sensitivity and the reduction of the sensitivity after storage is less compared with comparative dyes.

A silver halide photographic material which is high sensitive and excellent in storage stability can be obtained according to the present invention.

While the invention has been described in detail and with reference to specific examples thereof, it will be apparent to one skilled in the art that various changes and modifications can be made therein without departing from the spirit and scope thereof.

What is claimed is:

1. A silver halide photographic material which comprises at least one methine compound represented by the following formula (I) or (II):

(I)

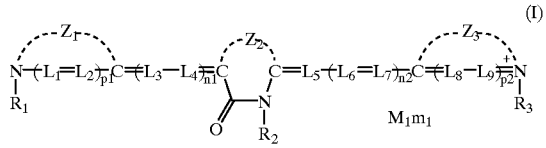

$M_1m_1$ wherein $Z_1$, $Z_2$ and $Z_3$ each represents an atomic group necessary to form a 5- or 6-membered nitrogen-containing heterocyclic ring; $R_1$ and $R_3$ each represents an alkyl group; $R_2$ represents a hydrogen atom, an alkyl group, an aryl group or a heterocyclic group; $L_1$, $L_2$, $L_3$, $L_4$, $L_5$, $L_6$, $L_7$, $L_8$ and $L_9$ each represents a methine group; $p_1$ and $p_2$ each represents 0 or 1; $n_1$ and $n_2$ each represents 0, 1, 2, 3 or 4; $M_1$ represents a counter ion to balance a charge; and $m_1$ represents a number of 0 or more necessary to neutralize a charge in the molecule;

(II)

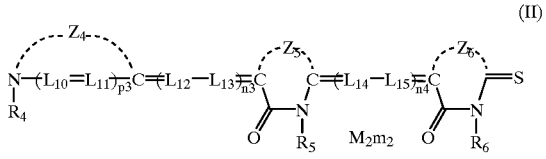

$M_2m_2$ wherein $Z_4$, $Z_5$ and $Z_6$ each represents an atomic group necessary to form a 5- or 6-membered nitrogen-containing heterocyclic ring; $R_4$ represents an alkyl group; $R_5$ and $R_6$ each represents a hydrogen atom, an alkyl group, an aryl group or a heterocyclic group; $L_{10}$, $L_{11}$, $L_{12}$, $L_{13}$, $L_{14}$ and $L_{15}$ each represents a methine group; $p_3$ represents 0 or 1; $n_3$ and $n_4$ each represents 0, 1, 2, 3 or 4; $M_2$ represents a counter ion to balance a charge; and $m_2$ represents a number of 0 or more necessary to neutralize a charge in the molecule;

wherein in formula (I), at least one of $R_1$, $R_2$, $R_3$, $Z_1$, $Z_2$ and $Z_3$ has a thioether group, and in formula (II), at least one of $R_4$, $R_5$, $R_6$, $Z_4$, $Z_5$ and $Z_6$ has a thioether group; and wherein the thioether group is represented by the following formula (X):

$$-(A_1)_{k2}-S-Q_1 \quad (X)$$

wherein $A_1$ represents an alkylene group, an alkenylene group, alkynylene group, an arylene group or a divalent heterocyclic group; $k_2$ represents 0 or 1; and $Q_1$ represents an alkyl group, an aryl group or a heterocyclic group.

2. The silver halide photographic material as claimed in claim 1, wherein the heterocyclic ring having a thioether group in the methine compound represented by formula (I) or (II) is a nucleus other than a quinoline nucleus and a pyridine nucleus.

3. A silver halide photographic material which comprises at least one methine compound represented by the following formula (I) or (II):

(I)

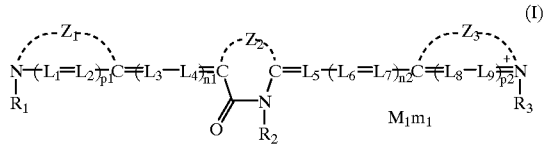

$M_1m_1$ wherein $Z_1$, $Z_2$ and $Z_3$ each represents an atomic group necessary to form a 5- or 6-membered nitrogen-containing heterocyclic ring; $R_1$ and $R_3$ each represents an alkyl group; $R_2$ represents a hydrogen atom an alkyl group, an aryl group or a heterocyclic group; $L_1$, $L_2$, $L_3$, $L_4$, $L_5$, $L_6$, $L_7$, $L_8$ and $L_9$ each represents a methine group; $p_1$ and $p_2$ each represents 0 or 1; $n_1$ and $n_2$ each represents 0, 1, 2, 3 or 4; $M_1$ represents a counter ion to balance a charge; and $m_1$ represents a number of 0 or more necessary to neutralize a charge in the molecule;

(II)

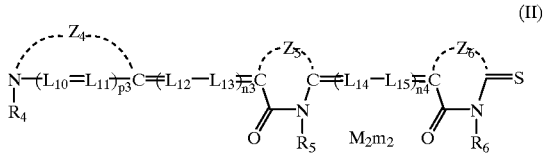

$M_2m_2$ wherein $Z_4$, $Z_5$ and $Z_6$ each represents an atomic group necessary to form a 5- or 6-membered nitrogen-containing heterocyclic ring; $R_4$ represents an alkyl group; $R_5$ and $R_6$ each represents a hydrogen atom, an alkyl group, an aryl group or a heterocyclic group; $L_{10}$, $L_{11}$, $L_{12}$, $L_{13}$, $L_{14}$ and $L_{15}$ each represents a methine group; $p_3$ represents 0 or 1; $n_3$ and $n_4$ each represents 0, 1, 2, 3 or 4; $M_2$ represents a counter ion to balance a charge; and $m_2$ represents a number of 0 or more necessary to neutralize a charge in the molecule;

wherein in formula (I), at least one of $R_1$, $R_2$, $R_3$, $Z_1$, $Z_2$ and $Z_3$ has a thioether group, and in formula (II), at least one of $R_4$, $R_5$, $R_6$, $Z_4$, $Z_5$ and $Z_6$ has a thioether group; and wherein the thioether group is represented by the following formula (X):

$$-(A_1)_{k2}-S-Q_1 \quad (X)$$

wherein $A_1$ represents an alkylene group, an alkenylene group, alkynylene group, an arylene group or a divalent heterocyclic group; $k_2$ represents 0 or 1; and $Q_1$ represents an alkyl group, an aryl group or a heterocyclic group;

wherein the methine compound represented by formula (I) is represented by the following formula (III):

(III)

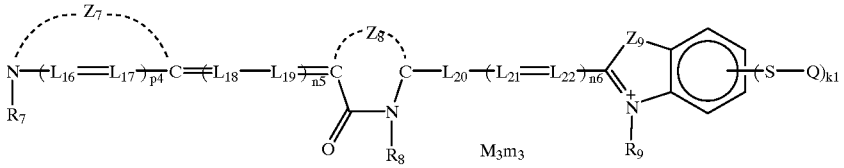

$M_3m_3$ wherein $Z_7$ has the same meaning as $Z_1$; $Z_8$ has the same meaning as $Z_2$; $Z_9$ represents a sulfur atom, a selenium atom or an oxygen atom; $R_7$ has the same meaning as $R_1$; $R_8$ has the same meaning as $R_2$; $R_9$ has the same meaning as $R_3$; $L_{16}$ has the same meaning as $L_1$; $L_{17}$ has the same meaning as $L_2$; $L_{18}$ has the same meaning as $L_3$; $L_{19}$ has the same meaning as $L_4$; $L_{20}$ has the same meaning as $L_5$; $L_{21}$ has the same meaning as $L_6$; $L_{22}$ has the same meaning as $L_7$; $p_4$ has the same meaning as $p_1$; $n_5$ has the same meaning as $n_1$; $n_6$ has the same meaning as $n_2$; $M_3$ has the same meaning as $M_1$; $m_3$ has the same meaning as $m_1$; Q represents an alkyl group, an aryl group or a heterocyclic group; and $k_1$ represents 1, 2, 3 or 4.

4. The silver halide photographic material as claimed in claim 3, wherein the methine compound represented by formula (III) is represented by the following formula (IV):

(IV)

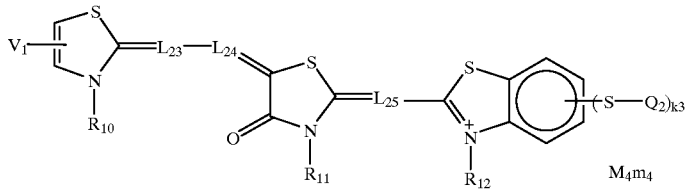

wherein $Q_2$ has the same meaning as Q; $k_3$ has the same meaning as $k_1$; $R_{10}$ has the same meaning as $R_1$; $R_{11}$ has the same meaning as $R_2$; $R_{12}$ has the same meaning as $R_3$; $L_{23}$ has the same meaning as $L_3$; $L_{24}$ has the same meaning as $L_4$; $L_{25}$ has the same meaning as $L_5$; $M_4$ has the same meaning as $M_1$; $m_4$ has the same meaning as $m_1$; and $V_1$ represents a monovalent substituent.

5. A silver halide photographic material which comprises at least one methine compound represented by the following formula (I) or II):

(I)

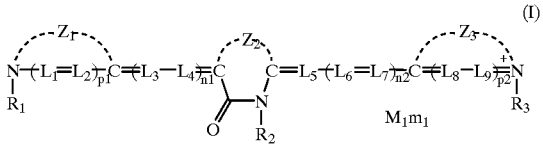

wherein $Z_1$, $Z_2$ and $Z_3$ each represents an atomic group necessary to form a 5- or 6-membered nitrogen-containing heterocyclic ring; $R_1$ and $R_3$ each represents an alkyl group; $R_2$ represents a hydrogen atom, an alkyl group, an aryl group or a heterocyclic group; $L_1$, $L_2$, $L_3$, $L_4$, $L_5$, $L_6$, $L_7$, $L_8$ and $L_9$ each represents a methine group; $p_1$ and $p_2$ each represents 0 or 1; $n_1$ and $n_2$ each represents 0, 1, 2, 3 or 4; $M_1$ represents a counter ion to balance a charge; and $m_1$ represents a number of 0 or more necessary to neutralize a charge in the molecule;

(II)

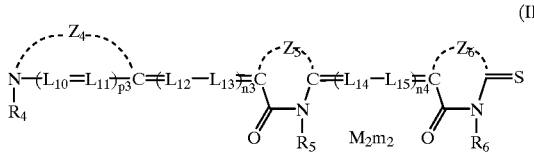

wherein $Z_4$, $Z_5$ and $Z_6$ each represents an atomic group necessary to form a 5- or 6-membered nitrogen-containing heterocyclic ring; $R_4$ represents an alkyl group; $R_5$ and $R_6$ each represents a hydrogen atom, an alkyl group, an aryl group or a heterocyclic group; $L_{10}$, $L_{11}$, $L_{12}$, $L_{13}$, $L_{14}$ and $L_{15}$ each represents a methine group; $p_3$ represents 0 or 1; $n_3$ and $n_4$ each represents 0, 1, 2, 3 or 4; $M_2$ represents a counter ion to balance a charge; and $m_2$ represents a number of 0 or more necessary to neutralize a charge in the molecule;

wherein in formula (I), at least one of $R_1$, $R_2$, $R_3$, $Z_1$, $Z_2$ and $Z_3$ has a thioether group, and in formula (II), at least one of $R_4$, $R_5$, $R_6$, $Z_4$, $Z_5$ and $Z_6$ has a thioether group; and wherein the thioether group is represented by the following formula (X):

$$-(A_1)_{k2}-S-Q_1 \qquad (X)$$

wherein $A_1$ represents an alkylene group, an alkenylene group, alkynylene group, an arylene group or a divalent heterocyclic group; $k_2$ represents 0 or 1; and $Q_1$ represents an alkyl group, an aryl group or a heterocyclic group;

wherein the methine compound represented by formula (I) of (II) is contained in an amount of 0.1 to 4 mmol per mol of silver halide.

* * * * *